US011512508B2

(12) United States Patent
Couto Maquieira et al.

(10) Patent No.: US 11,512,508 B2
(45) Date of Patent: Nov. 29, 2022

(54) OPENING CONTROL WITH MECHANICAL LIFT-UP

(71) Applicant: AKWEL VIGO SPAIN SL, Vigo Pontevedra (ES)

(72) Inventors: Delmiro Javier Couto Maquieira, Pontevedra (ES); Alberto Diez Estevez, Pontevedra (ES); Javier Casal Gomez, Vigo (ES); Jose Oscar Vazquez Carballo, Vigo (ES); Julio Garcia Rodriguez, Pontevedra (ES)

(73) Assignee: AKWEL VIGO SPAIN SL, Vigo Pontevedra (ES)

( * ) Notice: Subject to any disclaimer, the term of this patent is extended or adjusted under 35 U.S.C. 154(b) by 167 days.

(21) Appl. No.: 16/709,964

(22) Filed: Dec. 11, 2019

(65) Prior Publication Data

US 2020/0199918 A1 Jun. 25, 2020

(30) Foreign Application Priority Data

Dec. 20, 2018 (FR) ..... 18/73588

(51) Int. Cl.
*E05B 85/10* (2014.01)
*E05B 85/14* (2014.01)

(52) U.S. Cl.
CPC ..... *E05B 85/107* (2013.01); *E05B 85/103* (2013.01); *E05B 85/14* (2013.01)

(58) Field of Classification Search
CPC ..... E05B 85/107; E05B 2015/0403; E05B 85/10; E05B 5/003; E05B 5/006; Y10S 292/61; Y10S 292/31
See application file for complete search history.

(56) References Cited

U.S. PATENT DOCUMENTS

2016/0290018 A1* 10/2016 Hamacher ..... E05B 85/103

FOREIGN PATENT DOCUMENTS

FR 3024173 A1 * 1/2016
WO WO-2020048858 A1 * 3/2020 ..... E05B 81/90

OTHER PUBLICATIONS

"Restitute." Merriam-Webster.com Dictionary, Merriam-Webster, https://www.merriam-webster.com/dictionary/restitute. Accessed Oct. 12, 2021. (Year: 2021).*

* cited by examiner

*Primary Examiner* — Kristina R Fulton
*Assistant Examiner* — Emily G. Brown
(74) *Attorney, Agent, or Firm* — Oliff PLC

(57) ABSTRACT

The control comprises a handle flush mounted in a support and a kinematic chain for driving the handle in movement, comprising at least one rotary element for driving the handle in angular movement and at least one driving member configured to accumulate mechanical energy by mechanical work during a push-in action of the handle and to restitute mechanical energy to the drive kinematic chain after release of the handle. The handle includes a means for stabilizing the kinematic chain configured to limit the angulation of the rotary element of the chain during the push-in of the handle.

17 Claims, 10 Drawing Sheets

[Fig. 1]
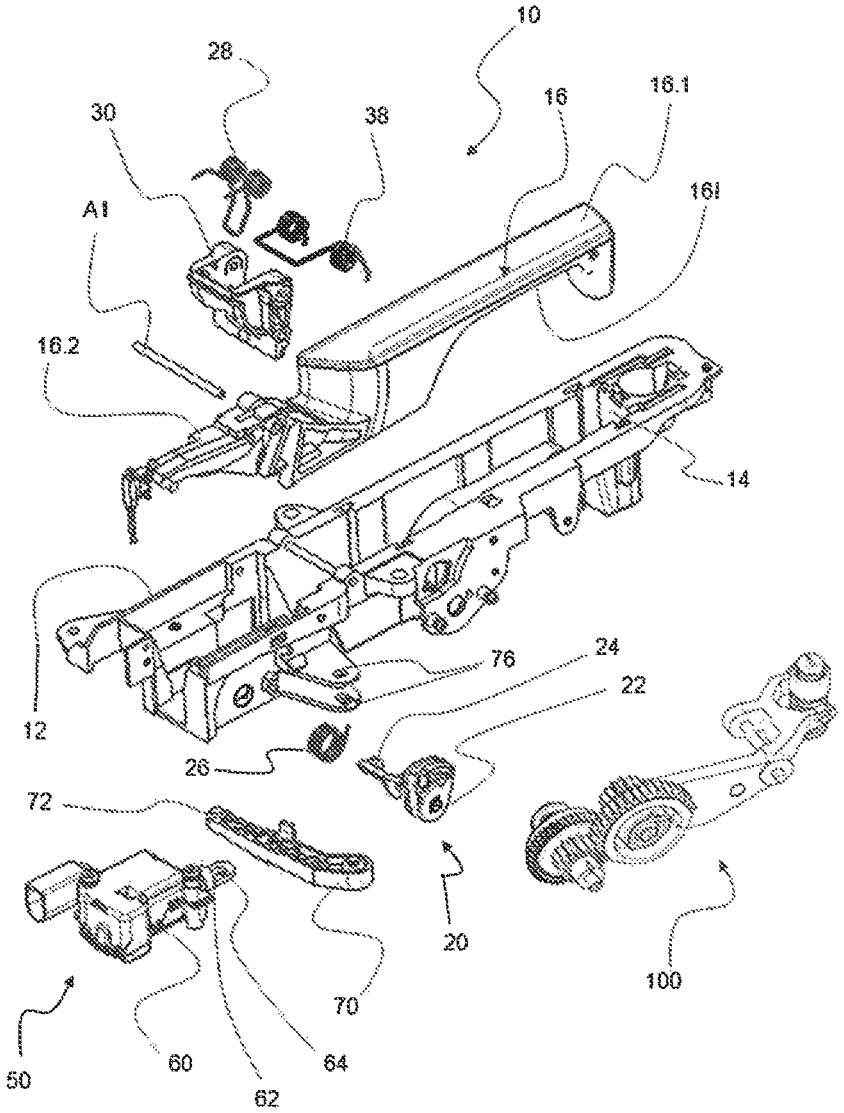

[Fig. 2]
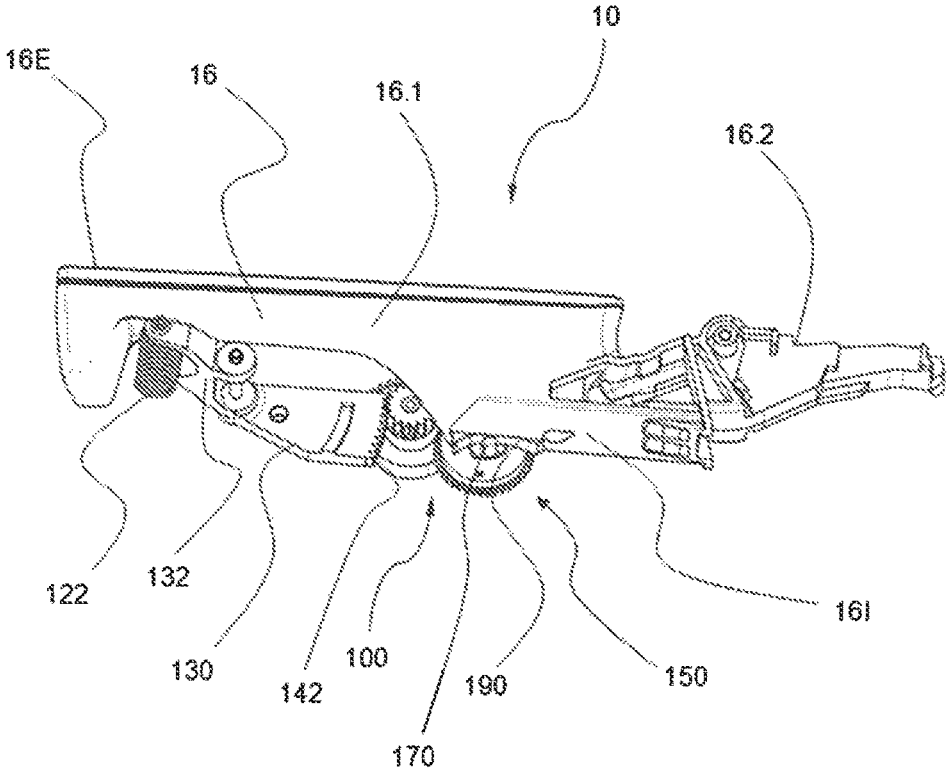
[Fig. 3]
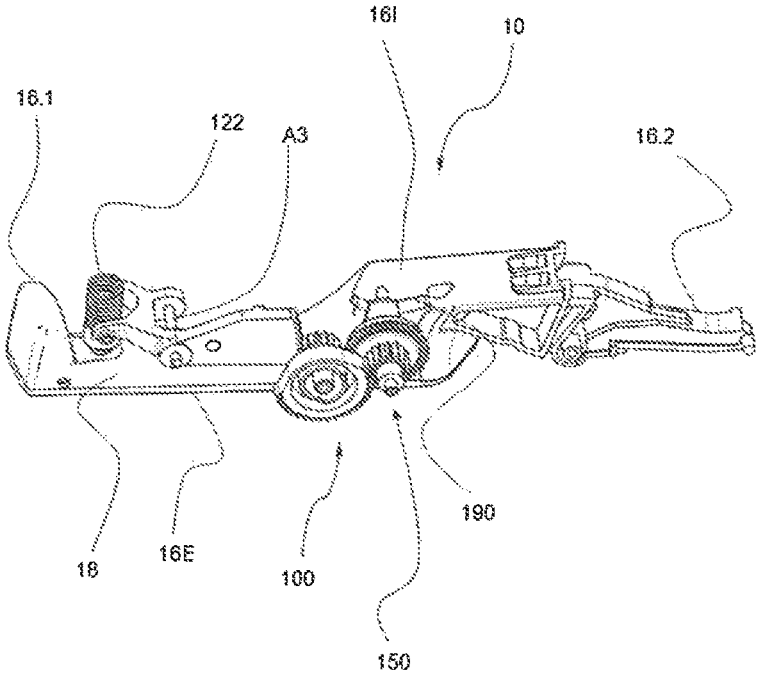

[Fig. 4]
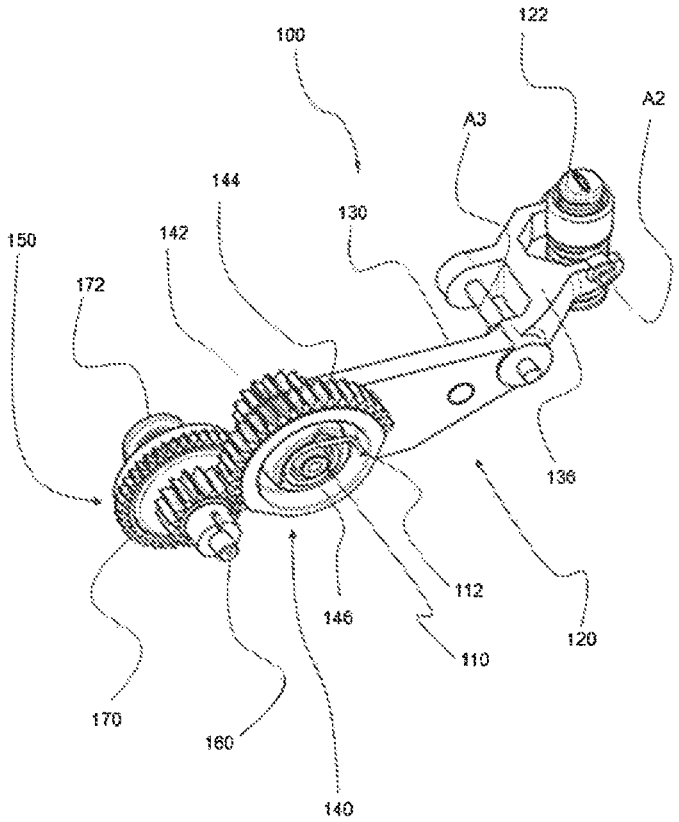

[Fig. 5]
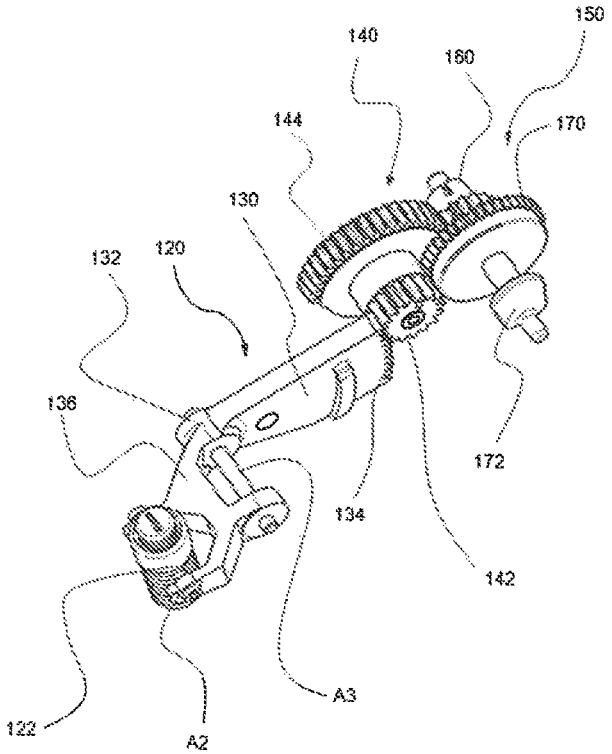
[Fig. 6]
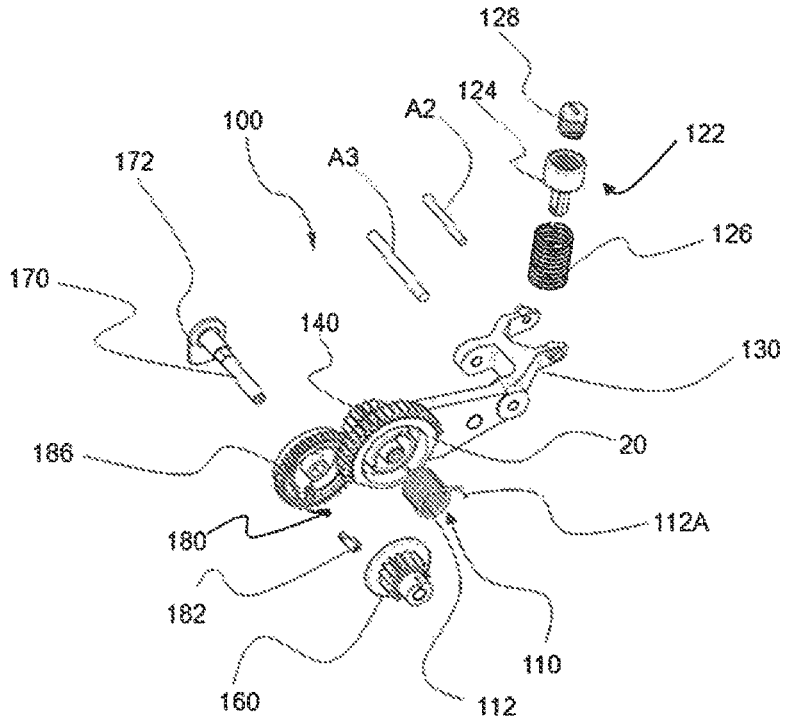

[Fig. 7]
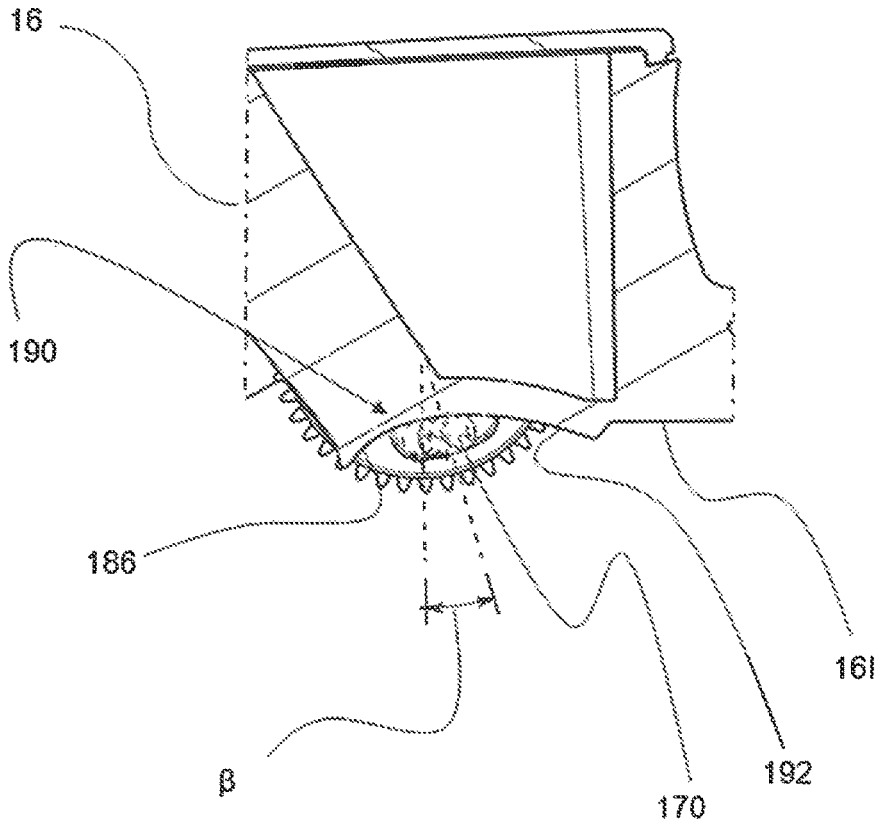
[Fig. 8]
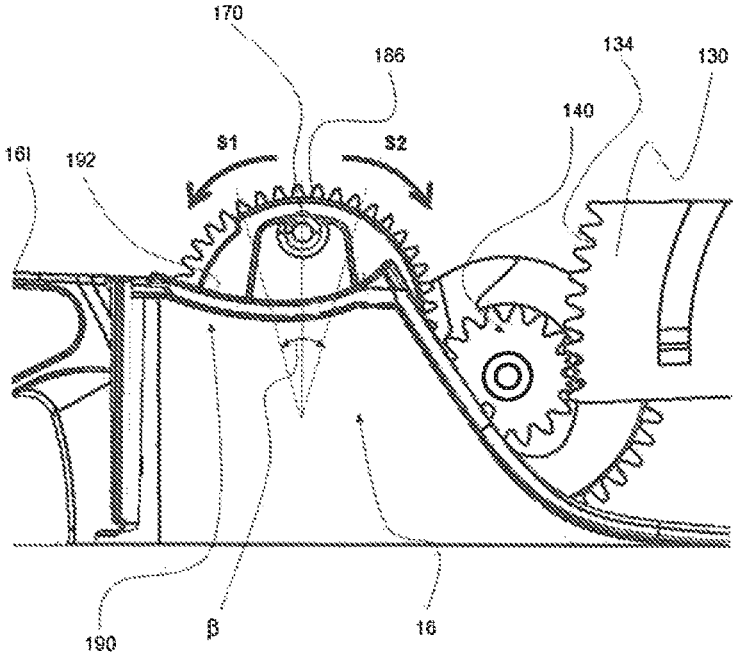

[Fig. 9]
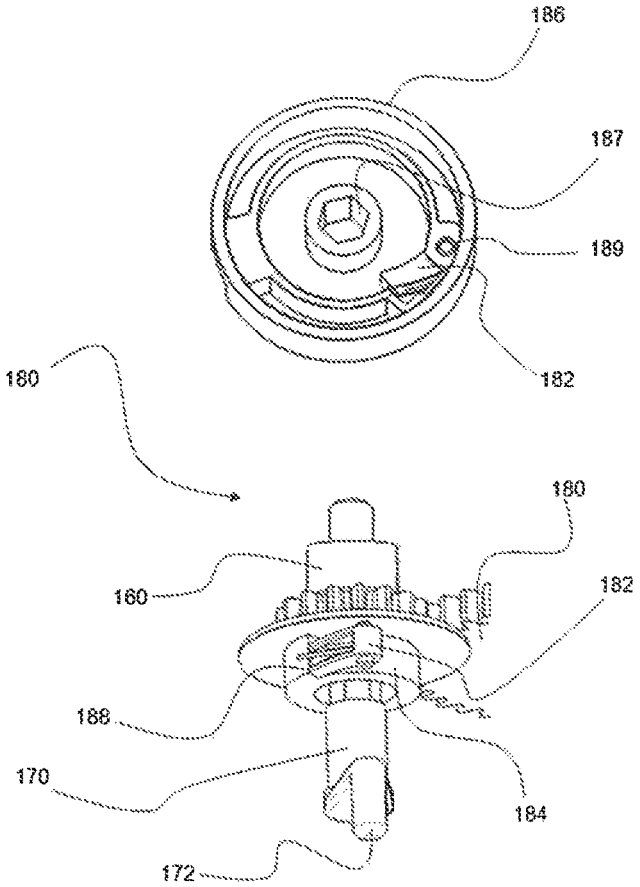

[Fig. 10]
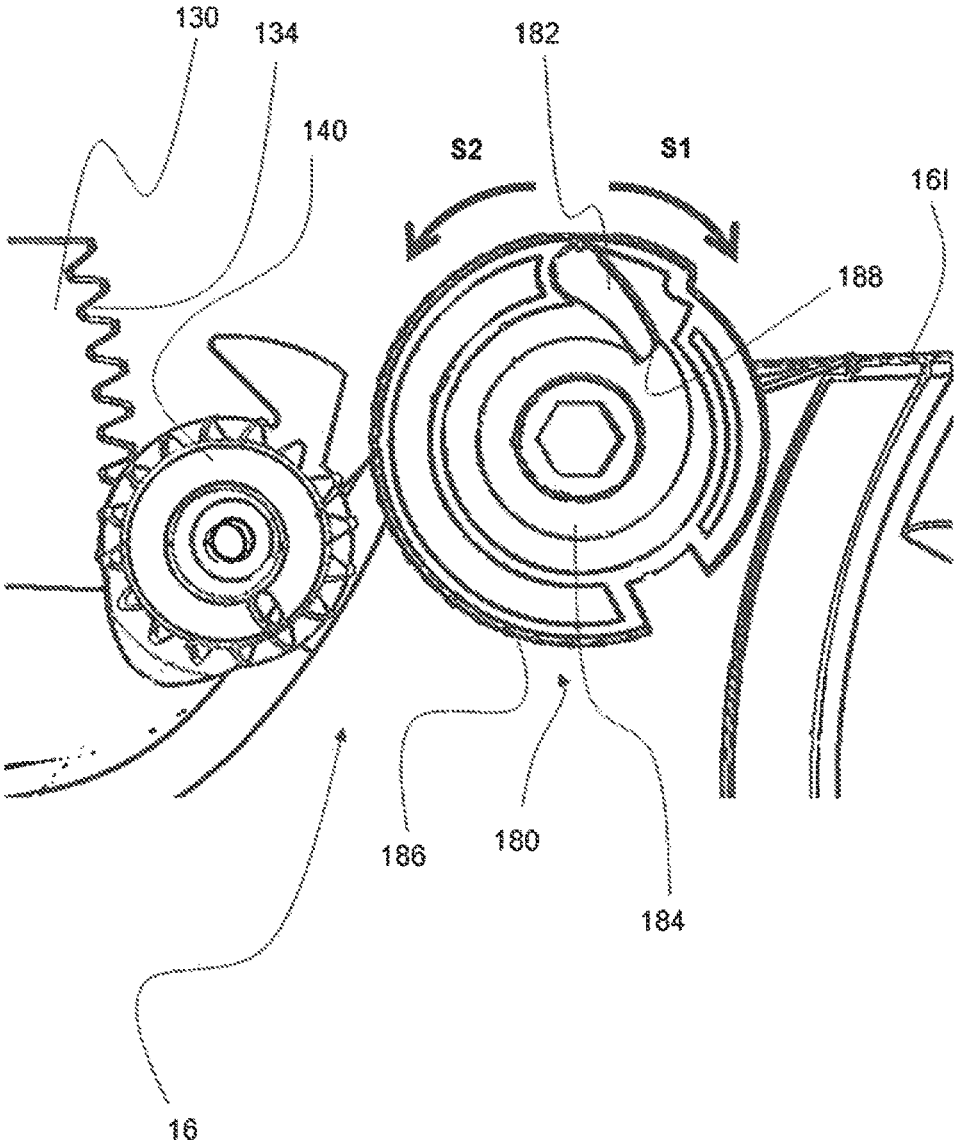

[Fig. 11]
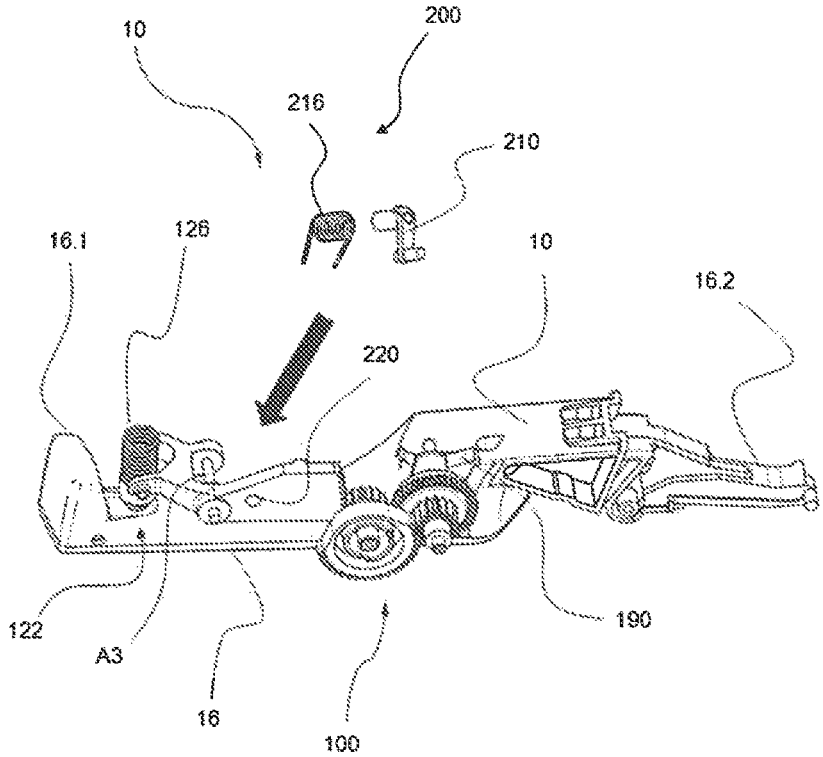
[Fig. 12]
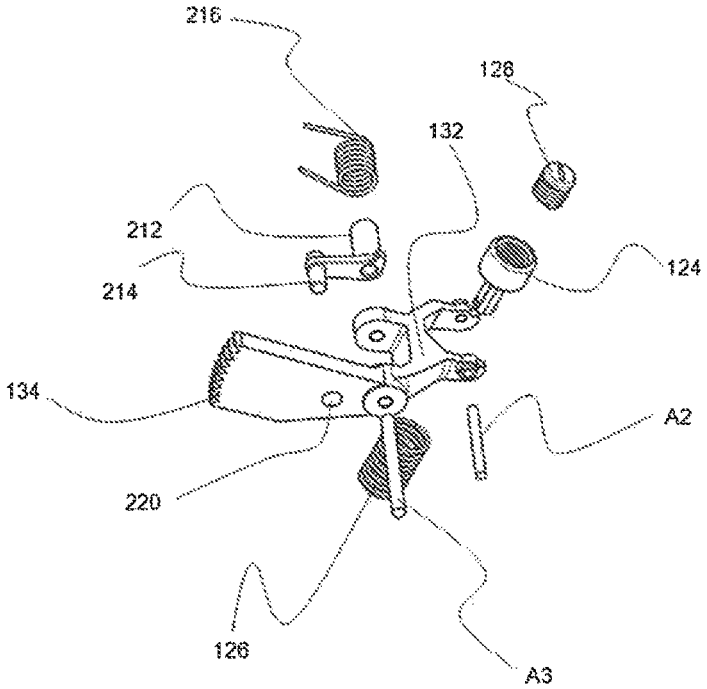

[Fig. 13]
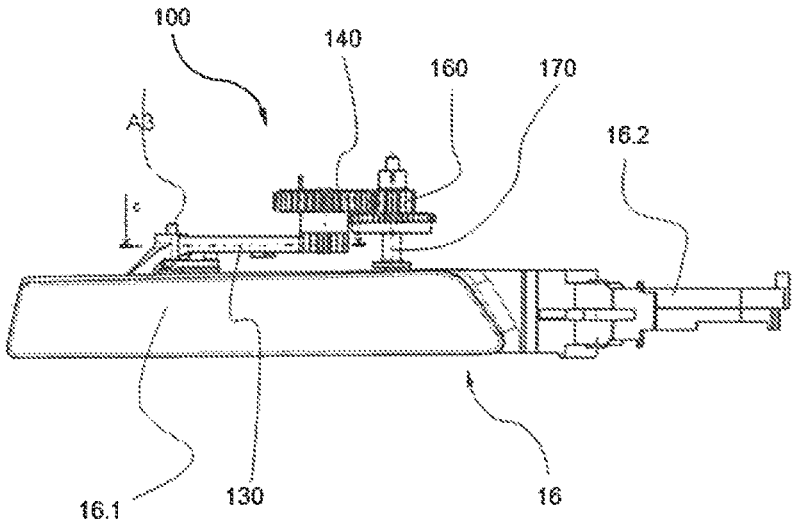
[Fig. 14]
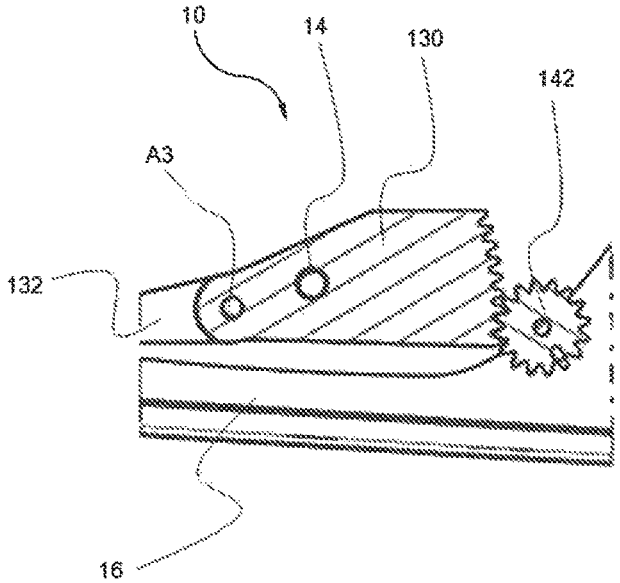

[Fig. 15]
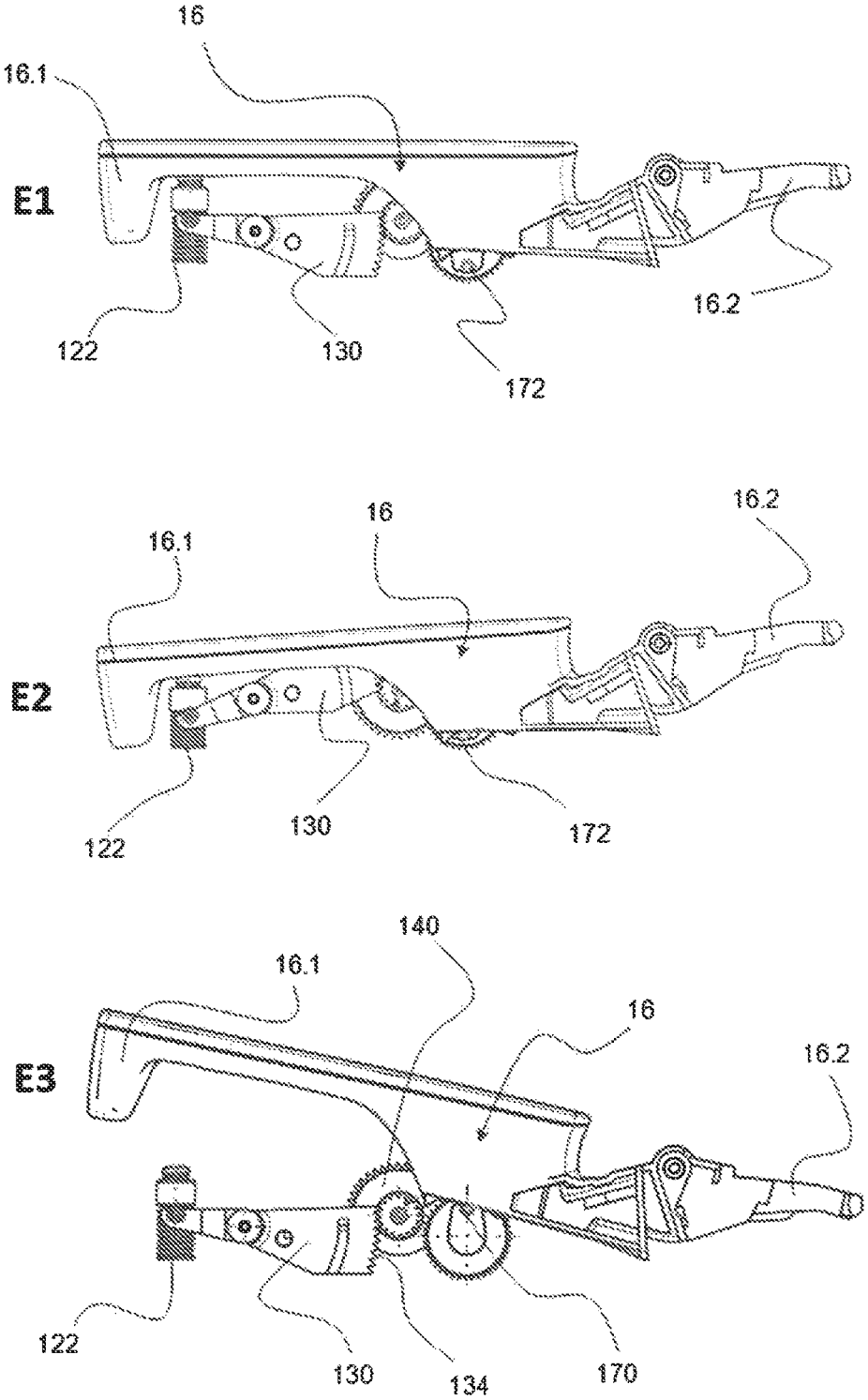

OPENING CONTROL WITH MECHANICAL LIFT-UP

TECHNICAL FIELD

The present invention concerns an opening control for a motor vehicle door leaf. More particularly but not exclusively, the invention concerns an external opening control which comprises backup mechanical unlocking means for the event of failure of the electrical actuation means of the opening control. This opening control applies to an unlocking with both a conventional latch or an electrically actuated latch, also known as «electronic latch» or «e-latch».

In general, an external opening control comprises a fixed support intended to be mounted on the door leaf and a handle movably mounted on the support, for example pivotally mounted on the support by being rotatably hinged about an axis. The opening control also comprises an unlocking mechanism, which, when the handle is pulled, enables the unlocking the latch and thus the opening of the door. The latch conventionally comprises a pin secured to the door adapted to cooperate with a striker secured to the bodywork. During the opening of the door from outside the vehicle, the pin is cleared from the striker by actuation of the external opening control.

More particularly, the invention concerns an opening control with a «flush» type handle, that is to say that the support on which the handle is movably mounted forms a cavity adapted to receive the handle in the retracted configuration. In this retracted configuration, the external surface of the handle is flush with the external surface of the external wall of the door leaf. In the extended or deployed configuration, the handle comes out at least partially from the cavity of the support so as to be able to be grasped by a user of the vehicle in order to open the door. For this purpose, the user can displace the handle further outwards in order to control the latch of the door. In general, the opening control comprises a mechanism for electrically ejecting the handle to enable the handling of the handle by the user and the opening of the door leaf. The electrical ejection mechanism operates from an electric power supply delivered for example by a battery of the motor vehicle and may be electronically controlled remotely thanks to a key, a mobile phone or any other device enabling a remote communication.

Nonetheless, in case of failure of this electric power supply, the electrically ejected handle cannot be used and the user cannot access to the vehicle. Hence, it is necessary to provide a backup mechanism allowing unlocking the door of the vehicle in particular when the battery has not enough energy for the electrical ejection mechanism to operate.

PRIOR ART

The invention aims at overcoming these drawbacks and providing an opening control which is compact, robust and allowing achieving a backup mechanical unlocking of the opening control in a simple manner.

SUMMARY OF THE INVENTION

To this end, an object of the invention is an opening control for a motor vehicle door leaf of the type comprising a handle movably mounted in rotation relative to a support between at least one intermediate rest position, an ejected position and a pushed position, a mechanism comprising a kinematic chain for driving the handle in movement comprising at least one rotary element for driving the handle in angular movement and at least one driving member configured to accumulate mechanical energy by mechanical work during a push-in action of the handle and to restitute mechanical energy to the drive kinematic chain after release of the handle, characterized in that the handle includes a means for stabilizing the drive kinematic chain configured to limit the angulation of the rotary element of the chain to a predefined angle value during the push-in of the handle.

Thanks to this manually-actuated mechanism, it is possible to eject the handle without electrical assistance. Moreover, the mechanism enables an automatic retraction of the handle in its flush position without the aid of any electrical assistance.

In another embodiment of the invention, the stabilizing means comprises a hooking member of the rotary element of the drive kinematic chain configured to hook the rotary element during the push-in of the handle and limit its angular displacement. In another embodiment of the invention, the handle comprises a body delimited by a lower surface being provided locally with a hooking profile forming the stabilizing means.

In another embodiment of the invention, the hooking profile locally has an arcuate general shape with a concavity oriented inwards the handle body, the curvature of the profile being determined in order to limit the angulation at a predefined angle. Furthermore, preferably, the hooking profile advantageously forms a curvilinear guide ramp configured to radially guide the rotary element. This guide ramp has a curvilinear shape, for example circular and is adapted to produce a regulating effect on the movement of the handle 16 in its drive direction.

In another embodiment of the invention, the stabilizing means being shaped as a hooking profile extending locally on an internal face of the handle, the rotary element is configured to be engaged tightly along the profile during push-in of the handle to limit its angulation to a predefined angle.

In another embodiment of the invention, the drive kinematic chain comprises a drive toothed wheel configured to perform a rotation by an angle of $2\pi+\alpha$, with the angle $\alpha$ larger than the angulation angle, during the push-in of the handle.

In another embodiment of the invention, the control comprises reversible unidirectional coupling means of the rotary element and of the drive wheel in a drive direction of the wheel.

In another embodiment of the invention, the coupling means comprise a snail-type cam provided with an end face and a blocking element movable between a biased position engaged with the end face and a retracted active position bearing on the periphery of the cam.

In another embodiment of the invention, the cam is carried by the drive wheel and the blocking element is mounted inside a cylindrical cage secured to the rotary element. In another embodiment of the invention, the rotary element comprises a lever for driving the handle in a reciprocating pivoting movement of the handle.

In another embodiment of the invention, the drive lever comprises a rotatably mounted shaft and an eccentric mounted on the shaft.

In another embodiment of the invention, the drive kinematic chain is configured to make the rotary element rotate over at least one complete turn in order to drive the ejection of the handle over the first half-turn and the retraction of the handle over a second half-turn.

In another embodiment of the invention, the control comprises a kinematic chain for loading energy into the driving member during the push-in of the handle.

In another embodiment of the invention, the loading kinematic chain comprises a spring-biased tappet member forming a push-in stop of the handle and configured to impart a movement during the release of the handle.

In another embodiment of the invention, the loading kinematic chain comprises at least one means for transmitting the push-in movement of the handle to the driving member.

In another embodiment of the invention, the transmission means is a pivotally mounted lever and has a circular sector shape pivotally connected at one end to the push-in stop member of the handle and forming at the other end a toothed gear circular arc.

In another embodiment of the invention, the driving member comprises a helical torsion spring.

BRIEF DESCRIPTION OF THE DRAWINGS

Other features and advantages of the invention will appear in light of the following description, made with reference to the appended drawings in which:

FIG. 1 is an exploded perspective view of an opening control according to the invention;

FIG. 2 a perspective view of a handle of the opening control of FIG. 1 comprising a backup mechanism for driving in movement the handle according to the invention;

FIG. 3 is a perspective view of the handle of FIG. 2 from another viewpoint;

FIG. 4 is a perspective view of one side of the backup mechanism of FIG. 2;

FIG. 5 is a perspective view of the backup mechanism of FIG. 4 viewed from the opposite side;

FIG. 6 is an exploded perspective view of the backup mechanism of FIGS. 4 and 5;

FIG. 7 is a sectional view of a hooking profile of the backup mechanism according to the invention;

FIG. 8 is a partial sectional view of the opening control according to the invention illustrating the operation of a means for stabilizing a drive kinematic chain of the opening control during the push-in of the handle;

FIG. 9 is a detailed perspective view of a unidirectional coupling means of the backup mechanism according to the invention;

FIG. 10 is a partial sectional view of the opening control according to the invention illustrating the operation of the unidirectional coupling means of FIG. 9;

FIG. 11 is a perspective view illustrating the mounting on the handle of a hard point crossing system;

FIG. 12 is an exploded partial perspective view of the hard point crossing system of FIG. 11;

FIG. 13 is a top view of the handle and its movement drive mechanism according to the invention;

FIG. 14 is an enlarged partial sectional view along the line C-C of FIG. 13;

FIG. 15 illustrates three operating states E1 to E3 of the opening control according to the invention: a first rest state, a state during push-in and a state of release of the handle.

DESCRIPTION OF THE EMBODIMENTS

In FIG. 1, there is represented an opening control for a motor vehicle door leaf according to a preferred embodiment of the invention. This opening control is referred to by the general reference numeral 10.

In the described example, the opening control 10 is intended to be mounted on an external panel (not represented) of the bodywork of a door leaf which is for example a vehicle side door.

For example, the opening control 10 mainly includes a fixed support or case 12 having a cavity 14 for receiving a handle and a handle 16 movably mounted inside the cavity 14. In service, the support 12 is intended to be fastened to the door leaf. In the described example, the handle 16 is hingedly mounted relative to the panel, about a geometric pivot axis A1, on the support 12 and extends parallel to the general plane of the external panel.

In the illustrated example, the support 12 has a parallelepiped general shape and is adapted to be housed within a cutout or a recess of the external panel of the door leaf such that its external face is flush with the surface of the external panel of the door leaf. In this example, the support 12 delimits a cavity 14 open on one side and intended to house the handle 16.

In the described example, the handle 6 has an outer portion 16.1 that the user can grasp. Opposite to the outer portion 16.1, the handle 16 has an inner portion 16.2 which is intended to extend inside the housing 14 of the case or support 12 as shown in FIG. 1.

In the described example, the handle 16 is of the «flush» type, that is to say that the support 12 on which the handle 16 is movably mounted delimits the cavity 14 adapted to receive the handle 16 in a retracted configuration. Preferably, in this retracted configuration, the external surface of the handle 16 is flush with the external surface of the external wall of the door leaf. In the extended or deployed configuration, the handle 16 extends at least partially from the cavity 14 of the support 12 so as to be able to be grasped by a user of the vehicle in order to open the door. For this purpose, for example, the user can pull the handle 16 further outwards in order to control the latch of the door. In the flush position, the external surface of the handle 16 coincides with the external surface of the door leaf. This «flush» arrangement, known in the automotive industry, allows enhancing the style of the vehicle and reduces the aerodynamic drag.

Nonetheless, it should be understood that other movable mountings may be considered, such as in particular by pivoting about an axis located at another position or else by translating along a direction essentially perpendicular to the midplane of the door. It should also be noted that the movable mounting of the handle relative to the support is known per so to those skilled in the art.

Preferably, the opening control 10 is intended to cooperate with a latch (not represented) of the door leaf of the motor vehicle prone to adopt a locked configuration and an unlocked configuration. Conventionally, the pivoting of the handle 16 about its hinge axis A1 actuates the latch in either one of its two locked or unlocked configuration via a drive kinematic chain (not represented in the figures).

To this end, as illustrated in FIG. 1, the opening control 10 comprises a counter lever 20. In the described example, this counter lever 20 comprises a rotary cage 22 and a counter shaft 24 as well as a counter return spring 26 intended to be housed inside the rotary cage 22. For example, the rotary cage 22 comprises a means for retaining an end of a Bowden cable (not represented). The set 20 is intended to be mounted on the support 12 as illustrated in FIG. 1.

In the example illustrated in FIG. 1, optionally, the opening control 10 comprises an electrical portion 50 enabling an electrical actuation of the ejection and/or the retraction of the handle 16.

We will now describe in detail the electrical portion 50. For its electrical operation, as illustrated in FIG. 1, the opening control 10 preferably further comprises a lever 30 for pivoting the handle 16 in ejection and/or in retraction. This pivot lever 30 is preferably mounted so as to tilt about the pivot axis A1 of the handle 16. Thus, in the described example, the pivot lever 30 is connected to the handle 16 by at least one common axis of rotation A1 fixed with respect to the case 12.

This pivot lever 30 has for example a caliper-like general shape through which the inner portion 16.1 of the handle can be engaged (FIG. 1). Thus, in the described example, the caliper 30 preferably comprises a body delimiting a framework inside which the inner branch 16.2 of the handle 16 can be introduced.

The caliper 30 preferably comprises a caliper head extending above the handle 16 and a caliper floor bearing on the underside of the handle 16. The head and the floor are connected together preferably by two bent lateral branches at the top of which the caliper 30 is hinged. The bent lateral branches have for example an «L» like general shape and the top is formed at the angle of the «L». The caliper head preferably comprises an upper link transverse bar and the caliper floor is formed by a lower link transverse bar. Furthermore, preferably, the lower face 161 of the handle 16 comprises a shoulder delimiting a transverse bearing wall from which the inner branch 16.2 axially extends and against which bears from below the caliper 30 to make the handle 16 pivot. In this example, the lower strip of the caliper 30 bears on this bearing wall at the level of the inner branch 16.2, in order to act as a lever and thus tilt the handle 16 up to its ejection position.

This caliper 30 can for example pivot about an axis A1 common to the handle 16 which is secured to the case 12. To this end, in the described example, the caliper 30 comprises a hinge support, located at the location of the tips, provided on each side with two guide bearings for rotating the caliper 30 about the axis A1.

In this example, the caliper 30 generally has at the front a hoop-like general shape inside which the inner branch 16.2 is introduced in a direction of introduction substantially perpendicular or slightly oblique to the plane containing the hoop. The hoop preferably connects the head and the floor by two arcuate lateral arms. The ejection caliper 30 has, for example, first and second lateral solid cheeks parallel to each other and perpendicular to the common axis of rotation A1.

The opening control 10 further comprises, for example, a return member 38 connected to the caliper 30. This return member 38 is preferably configured to urge the caliper 30 to a rest position corresponding to the flush configuration of the handle 16. It is shown in FIG. 1 that each of the two legs of the caliper spring 38 is intended to be fastened to an internal wall of the case 12.

In the described example, the handle 16 is provided with a handle 16 return member 28 which is placed between the caliper 30 and the inner portion 16.1 of the handle 16 and which have as a common axis the axis A1 The handle return spring 28 has in this example two legs intended to be fastened to the caliper 30 and a central portion engaged with the inner portion 16.2. The function of the handle return spring 28 is in this example to take up, by a return force, a clearance between the inner portion 16.1 and the caliper 30. Preferably, the handle 16 is configured to pivot freely inside the caliper 30 when the caliper 30 is stationary against the handle 16 return spring 28 within the limit of a predefined angular displacement clearance inside the caliper 30. Furthermore, the electrical operation portion 50 comprises in this example an electric actuator 60 connected to an ejection arm 70 intended to transversely extend inside the case 12 in a pivoting manner as shown in FIG. 1. The electric actuator 60 preferably comprises a linear cylinder 62 provided with an end 64 cooperating with an end 72 of the ejection arm so as to make the ejection arm 70 pivot about a vertical axis. For example, the end 64 comprises a notch and the end 72 comprises a protruding lug. The ejection arm 70 comprises, as illustrated for example in FIG. 2, an end 74 pivotally mounted between two parallel flanges 76 of the case 12.

In accordance with the invention and as illustrated in FIG. 1, the opening control 10 further comprises a mechanism 100 enabling a mechanical actuation of an ejection and retraction movement of the handle 16.

In particular, the mechanism 100 is configured to be mechanically triggered in response to a push-in action in the case 12 of the handle 16, the end of the push-in or release action being adapted to cause the release of the mechanism 100.

As illustrated in FIGS. 2 and 3, the backup mechanism 100 is intended to be mounted so as to cooperate with the handle 16. The backup mechanism 100 is, as illustrated in FIG. 1, mounted secured to the receiving case 12 of the handle 16. The mechanism 100 thus comprises a kinematic chain 150 for driving in movement the handle 16 to automatically drive the handle 16 over all or part of a stroke starting from the pushed position of the handle 16 to the flush position through the ejected position. Preferably, the mechanism 100 is configured to drive the handle 16 in movement over the entire stroke.

As illustrated in detail in FIG. 4, the mechanism 100 comprises at least one driving member 110 configured to accumulate mechanical energy during the push-in action of the handle 16 and to restitute the accumulated mechanical energy to the drive kinematic chain 150 after the release of the handle 16.

In the illustrated example, the driving member 110 comprises a spring 112 adapted to accumulate mechanical energy by a work about its longitudinal axis. For example, the spring 112 is a coil spring comprising a spring body configured to work in compression, tension or torsion. Alternatively, the driving member 110 may comprise any type of spring, and in particular not limited to a spiral coil spring.

Moreover, according to FIGS. 4 to 6, the mechanism 100 comprises in this example an energy loading kinematic chain 120 of the spring 112 during the push-in of the handle 16.

In the described example, the loading kinematic chain 120 comprises at least one means 130 for transmitting the push-in movement of the handle 16 to the driving member 110.

Preferably, the loading kinematic chain 120 further comprises a member 122 forming a push-in stop of the handle 16 and configured to impart a movement during the release of the handle 16. This member 122 forming a stop comprises in the example a tappet element 124 with a spring 126. The tappet element 124 has for example a general shape of a cylindrical sleeve extended at one end by an axial rod around which the spring 126 is positioned and has at another end an elastomeric stop 128. The push-in stop member 122 is preferably intended to come into contact with a lower face 161 of the outer portion 16.1 of the handle 16.

In the illustrated example and as shown in detail in FIG. 1, the transmission means is a lever 130 pivotally mounted about an axis secured to the case 12. The lever 130 preferably has a circular sector shape pivotally connected at a first end 132 to the push-in stop member 122 of the handle 16 and forming at a second end 134 a toothed gear circular arc.

For example, the end 132 of the transmission lever 130 terminates in a fork 136 comprising two branches forming «U» configured to support a transverse pivot axis A2 of the stop member 122.

In this example, during the push-in phase of the handle 16 by an operator, the pivoting of the handle 16 about its axis A1 causes a displacement of the stop 122 by compression of its return spring 126. In this example, the lower end of the stop member 122 is rotatably connected to the transmission lever 130 by the axis A2, so that a displacement of the stop 122 causes the rotation of the transmission lever 130 about its axis A3 (FIGS. 13 and 14).

The drive kinematic chain 150 will now be described in more detail below. Preferably, as shown in FIG. 6, the drive kinematic chain 150 comprises at least one drive wheel 160 provided for example with a peripheral gear toothing. The function of this drive wheel 160 is to transmit to the drive kinematic chain 150 the accumulated energy of the driving member 110. To this end, the wheel 160 is coupled to the lift-up kinematic chain 120 and is preferably mounted directly or indirectly under the tension of the driving member 110.

Thus, in the described example and as illustrated in FIG. 5, the lift-up kinematic chain 120 optionally further comprises a transmission gear-train 140, interposed between the transmission lever 130 and the drive wheel 160. This transmission gear-train 140 is composed, in the example, of an input pinion 142 cooperating with the gear 134 of the transmission lever 130 and an output pinion 144 cooperating with the input pinion 142 and the drive wheel 160.

Nonetheless, in a variant which is not illustrated by the present figures, the drive wheel 160 may be directly coupled with the gear 134 of the transmission lever 130. In the illustrated example, the driving member 110 is housed coaxially in a cylindrical cavity 146 of the output pinion 144 of the gear-train 140. Alternatively, the driving member 110 may be coupled directly to the drive wheel 160 or with another transmission chain configuration.

Preferably, the kinematic chain 150 further comprises a rotary element 170 for transmitting an angular pivoting movement to the handle 16. This rotary element 170 is preferably configured to transform a rotary movement, for example of the rotary wheel 160, in a reciprocating movement of the handle 16. Thus, for example, the rotary element 170 comprises a lever 170 for driving the handle 16 in a reciprocating pivoting movement of the handle 16 along said stroke. The lever 170 comprises for example a drive shaft 172 rotatably mounted and provided with an eccentric 174. Preferably, the drive kinematic chain 150 is configured to make the drive lever 170 rotate over at least one complete turn in order to drive the ejection of the handle 16 over a first half-turn and the retraction of the handle 16 over a second half-turn.

The transmission ratio from the transmission means 130 to the driving member 110 is preferably defined such that the push-in of the handle 16 causes an angular rotation of the driving pinion 160 larger than $2\pi$.

In accordance with the invention, the opening control 10 comprises a means 190 for stabilizing or holding in a stable position the drive kinematic chain 150 during the push-in of the handle 16, shown in FIGS. 7 and 8. This means 190 is preferably mounted on the handle 16. This means 190 is configured to limit the angulation (or angular displacement) of the lever 170 to a predefined value of an angle $\beta$ during the push-in of the handle 16.

The holding means 190 preferably comprises a hooking profile 192 of the drive lever 170 shaped so as to limit the angulation of the lever 170 by a predefined angle $\beta$ during the push-in of the handle 16. In the illustrated example, the handle 16 comprises a body delimited by a lower surface 161 and an upper surface 16E, the lower surface 161 being locally provided with the hooking profile 192.

In this example, the profile 192 locally has an arcuate general shape with a concavity oriented inwards the body of the handle 16. Preferably, the curvature of the profile 192 is determined in order to limit the angulation of the lever 170 to the predefined angle $\beta$. Preferably, the profile 192 forms a guide ramp or cam of the lever 170 and its crankpin 172 configured to produce a regulating effect in the drive direction S2 of the handle 16 in movement. Indeed, in the described example, the guide ramp 192 has a curvilinear shape, preferably in a circle arc. The circular arc shaped guide ramp 192 thus allows optimizing the ejection forces relative to a flat shape.

In the described example, the drive kinematic chain 150 is configured to drive in rotation, for example via the drive wheel 160, the shaft 170 of the eccentric 172 by an angle of $2\pi+\alpha$, with $\alpha$ larger than $\beta$ to catch the angle of rotation $\beta$. Thus, thanks to the excess turn performed by the drive gear 160, even if the shaft 170 has rotated by an angle $\beta$, this angle of rotation will be absorbed by the excess rotation $\alpha$.

Moreover, preferably, the drive lever 170 and the toothed wheel 160 or drive pinion 160 comprise reversible unidirectional coupling means 180 of the lever 172 and the wheel 160 in the drive direction.

These means 180 are represented in detail in FIGS. 9 and 10. The means 180 comprise, for example, a cam 184 of the snail, spiral or retraction ramp type provided with at least one end face 188 and a blocking element 182 movable between a biased position abutting against the end face 188 and a retracted active position bearing on the periphery of the cam 184.

For example, the cam 184 is carried by the toothed wheel 160 and the blocking element 182 or blacker 182 is mounted inside a cylindrical cage 186 secured to the drive shaft 170. In the example, the cage 186 is shaped as a hub body receiving the drive shaft 170, in particular by a fluted connection 187 of the hexagonal type. Preferably, the toothed wheel 160, as illustrated in detail in FIG. 9, comprises according to an axial direction and coaxially mounted a toothed portion 162 and a portion 164 carrying a cam 184 mounted coaxially with the toothed portion 162.

As illustrated in FIG. 9, the blocker 182 is movably mounted inside the cage 186 between an interaction biased position projecting inside the cage 186 against the end face 188 and a retracted position tangentially to an inner wall of the cage 186.

The blacker 182 comprises for example a pivoting pawl elastically biased into the biased position by a spring 189. The pivoting pawl 182 of the receiving cage 186 allows transmitting the torque of the driving spring 110 to the receiving cage 186. The torque will be transmitted once the power spring 112 is raised by a turn of the drive wheel 160. The pawl 182 is biased against the cam 184 and by the action of its return spring.

The operating principle of this unidirectional coupling means is illustrated in detail in FIG. 10.

At rest, the cam 184 of the drive wheel 160 is stationary. The pawl 182 is blocked in the direction of rotation S1 by the end face 188 but is free to be displaced in the direction of rotation S2. Thanks to the hooking profile 190, the rotation in the direction S2 of the drive lever 170 is limited to an angle β.

During the lift-up of the driving member 110 and therefore the push-in of the handle 16, the drive wheel 160 is rotated in the direction S1 by the transmission lever 130 via the transmission gear-train 140. In this case, the pawl 182 is no longer in the blocked position against the end stop face 188 which has already rotated in a secured manner with the drive wheel 160. Furthermore, the drive lever 170 is likely to unexpectedly move at the beginning of the push-in in both directions of rotation S1 and S2, for example by a friction effect.

During the push-in, in the direction of rotation S1, the snail cam 184 progressively retracts the pivoting pawl 182 during its rotation by one complete turn. In order to ensure the stabilization of the drive kinematic chain 150 during the push-in of the handle 16, it is necessary that at the end of the push-in, the drive wheel 160 returns to its initial position blocked by the pawl 182. It is therefore necessary that the pawl 182 be projecting inside the cam 184 and come into engagement with the end stop face 188. It is therefore necessary to ensure the absorption of an inadvertent angular displacement of the lever 170 within the predefined possible angulation β, in particular in the direction S2. This is ensured thanks to an excess a of rotation of the drive wheel 160 beyond one complete turn.

Thus, at the end of the push-in of the handle 16, the rotary pawl 182 again faces the stop 188 of the ramp of the cam 184, so that, when the handle 16 is released, the drive wheel 160 transmits its torque to the drive shaft 170 via the receiving cage 186 in the direction of rotation S2.

FIGS. 11 and 12 represent an opening command 10 according to a variant of the invention. In this variant, the opening control 10 further comprises a hard point crossing system 200. This hard point crossing system is in this optional example. Preferably, the hard point crossing means 200 comprises a member 210 pivoting about a hinge axis A3 carried by the transmission lever 130 and a member 216 for elastically biasing the pivoting member 210. For example, the pivoting member 210 comprises a crank 212 movable about the hinge axis A2 and a crankpin 212 eccentric with respect to the axis A2 and forming a stud 212.

To this end, in the described example, the transmission lever 130 is provided with an orifice 220 and the pin 212 is configured to project inside the orifice 220 and is displaceable throughout the orifice 220 from an upper rest position in which it is elastically biased by an elastic return member 216 to a lower active position for rotationally securing the transmission lever 130. In this example, the orifice 220 has an oblong general shape.

The main aspects of the operation of an opening control according to the invention will now be described with reference to the different diagrams of FIG. 15 illustrating a succession of steps E1 to E3 of operating the opening control 10 according to the invention.

Initially, according to the sketch E1, the handle 16 is flush with the case 12. In this initial position, the push-in stop member 122 is in a non-pushed state. Furthermore, the drive lever 170 with the eccentric 172 is in a lower position without contact with the hooking profile 192.

During a second step, illustrated in sketch E2, an operator pushes the handle 16 inside the housing 12 so as to make it rotate about its hinge axis A1. During the push-in, the handle 16 urges in compression the stop member 122 forming a push-in member. The axial push-in of the tappet member 122 triggers the lift-up kinematic chain of the driving member 110.

The handle 16 and more particularly the lower face 161 of the handle 16 acts on the push-in stop member 122 and compresses the push-in stop spring 126. During this action, the transmission lever 130 is pivotally driven.

Thus, the transmission lever 130 pivots about its axis A3 in a counter-clockwise direction while driving the drive wheel 160 in a counter-clockwise direction via the transmission gear-train 140.

From the flush position, illustrated in sketch E1, the operator pushes the handle 16 which transmits its rotation, via the stop 122 and the transmission lever 130, to the transmission gear-train 140.

During the push-in of the handle 16, the lever 170 remains in a stable position thanks to the handle 16, which includes a hooking profile 192 in the form of a circular arc and prevents the rotation of the lever 170 beyond a predefined angle «β».

The transmission gear-train 140 drives the drive wheel 160 by rotating it 360°+«α» (one turn+one predefined overstroke angle) in the direction of rotation S1 (FIG. 10). For optimal operation, the angle «α» must be larger than the angle «β». Thus, the angle «β» is absorbed by the overstroke angle «α». This excess angle allows compensating for an inadvertent angular movement of the drive lever 170. In particular, this allows ensuring that at the end of reloading of the helical spring 112, as illustrated in FIG. 10, the pawl 182 abuts against the end face 188 ready to start in the opposite direction of rotation S2 to actuate the drive chain 150 and cause the displacement of the lever 170.

According to the sketch E3, once the release of the handle 16 is operated, the energy for example of the spring 112 torsion is restituted to the drive wheel 160 which rotates in the direction of rotation S2. The cam 184 therefore rotates in the direction of rotation S2 while driving the pawl 182 with it. The drive lever thus also rotates in the direction of rotation S2 thus driving the lever 170 over a complete turn making the handle 16 rotate in a reciprocating movement.

Thanks to this effect, the backup mechanism 100 has a very simple and very robust design. Even in case of inadvertent rotation of the drive lever 172 during the push-in of the handle 16, this rotation is on the one hand limited to a predefined maximum angle β and further allows ensuring in any case the complete reloading of the system 10 and enabling the completion of the full stroke of the handle 16 from its pushed position to its flush position through the ejected position.

Of course, the invention is not limited to the previously described embodiments. Other embodiments within the reach of those skilled in the art may also be considered yet without departing from the scope of the invention defined by the claims hereinafter.

The invention claimed is:

1. An opening control for a motor vehicle door leaf comprising:

a support;

a handle rotatably mounted relative to the support between at least one rest position in which the handle is housed at least partially in the support, an ejected position in which the handle is at least partially out of the support and a pushed position; and a mechanism comprising a drive kinematic chain for driving the handle, the drive kinematic chain comprising:

at least one rotary element for driving the handle in angular movement, and at least one driving member configured to accumulate mechanical energy by mechanical work during a push-in action of the handle and to restitute mechanical energy to the drive kinematic chain after a release of the handle, wherein the handle includes a hooking profile forming a stabilizing means for stabilizing the drive kinematic chain configured to hold an angulation of the rotary element of the drive kinematic chain at a predefined angle value (β) while the push-in action of the handle continues.

2. The control according to claim 1, wherein the stabilizing means is configured to hook the rotary element during the push-in action of the handle.

3. The control according to claim 1, wherein the handle comprises a body, the body having a lower surface, the lower surface being locally provided with the hooking profile.

4. The control according to claim 3, wherein the hooking profile locally has an arcuate general shape with a concavity oriented inward towards the handle body, the curvature of the hooking profile being determined in order to limit the angulation to the predefined angle value (β).

5. The control according to claim 1, wherein the hooking profile extends locally on an internal face of the handle, and wherein the rotary element is configured to be engaged tightly along the hooking profile during the push-in action of the handle to limit its angulation to the predefined angle value (β).

6. The control according to claim 1, wherein the drive kinematic chain comprises a drive toothed wheel configured to perform a rotation by an angle of $2\pi+\alpha$, with the angle $\alpha$ larger than the predefined angle value (β), during the push-in action of the handle.

7. The control according to claim 6, comprising coupling means for reversibly coupling the rotary element and the drive toothed wheel in a drive direction of the drive toothed wheel.

8. The control according to claim 7, wherein the coupling means comprises a snail cam provided with an end face and a blocking element movable between a biased position engaged with the end face and a retracted active position bearing on a periphery of the snail cam.

9. The control according to claim 8, wherein the snail cam is carried by the drive toothed wheel and the blocking element is mounted inside a cylindrical cage secured to the rotary element.

10. The control according to claim 1, wherein the rotary element comprises a lever for driving the handle in a reciprocating pivotal movement.

11. The control according to claim 10, wherein the lever comprises a shaft rotatably mounted and an eccentric mounted on the shaft.

12. The control according to claim 1, wherein the drive kinematic chain is configured to cause the rotary element to rotate over at least one complete turn around an axis, from a starting position to at least one ending position, the ending position matching the starting position, in order to drive the ejection of the handle over a first half of the turn and the retraction of the handle over a second half of the turn.

13. The control according to claim 1, comprising a loading kinematic chain for loading energy into the driving member upon the push-in action of the handle.

14. The control according to claim 13, wherein the loading kinematic chain comprises a spring-biased tappet member forming a push-in stop of the handle and configured to impart a movement during the release of the handle.

15. The control according to claim 14, wherein the loading kinematic chain comprises at least one transmission means for transmitting the push-in action of the handle to the driving member.

16. The control according to claim 15, wherein the transmission means comprises a pivotally mounted lever, the pivotally mounted lever having a circular sector shape pivotally connected at one end to the push-in stop and forming at another end a toothed gear circular arc.

17. The control according to claim 1, wherein the driving member comprises a helical torsion spring.

* * * * *